US011285750B2

(12) United States Patent
Zaborowski et al.

(10) Patent No.: US 11,285,750 B2
(45) Date of Patent: Mar. 29, 2022

(54) COLLAPSIBLE RIBBON SUPPLY CARTRIDGE

(71) Applicant: ENTRUST CORPORATION, Shakopee, MN (US)

(72) Inventors: Alexander K. Zaborowski, Shakopee, MN (US); Bryan D. Hoeve, Shakopee, MN (US)

(73) Assignee: ENTRUST CORPORATION, Shakopee, MN (US)

( * ) Notice: Subject to any disclaimer, the term of this patent is extended or adjusted under 35 U.S.C. 154(b) by 0 days.

(21) Appl. No.: 16/577,402

(22) Filed: Sep. 20, 2019

(65) Prior Publication Data

US 2020/0094599 A1 Mar. 26, 2020

Related U.S. Application Data

(60) Provisional application No. 62/733,778, filed on Sep. 20, 2018.

(51) Int. Cl.

| | |
|---|---|
| ***B41J 33/24*** | (2006.01) |
| ***B41M 5/00*** | (2006.01) |
| ***B41J 32/00*** | (2006.01) |

(52) U.S. Cl.

CPC ..... *B41J 33/24* (2013.01); *B41J 32/00* (2013.01); *B41M 5/0064* (2013.01)

(58) Field of Classification Search

CPC ... B41J 33/24; B41J 32/00; B41J 17/32; B41J 3/385; B41J 33/16; B41J 33/22; B41M 5/0064

(Continued)

(56) References Cited

U.S. PATENT DOCUMENTS 4,299,504 A * 11/1981 Benz ..... B41J 33/26 400/196
4,609,298 A * 9/1986 Shioda ..... B41J 35/08 400/208

(Continued)

FOREIGN PATENT DOCUMENTS

| | | | |
|---|---|---|---|
| JP | 2001-130075 | A | 5/2001 |
| KR | 10-2005-0113162 | A | 12/2005 |
| WO | 2006-113753 | A2 | 10/2006 |

OTHER PUBLICATIONS

International Search Report and Written Opinion, International Patent Application No. PCT/IB2019/057997, dated Jan. 3, 2020 (11 pages).

*Primary Examiner* — Kristal Feggins
*Assistant Examiner* — Alexander D Shenderov
(74) *Attorney, Agent, or Firm* — Hamre, Schumann, Mueller & Larson, P.C.

(57) ABSTRACT

A ribbon supply cartridge for use in a card personalization machine. The ribbon supply cartridge is manually adjustable by a user before installation into the card personalization machine from a first, collapsed (or pre-use) configuration to a second, extended or open (or use) configuration. When the ribbon supply cartridge is adjusted from the first configuration to the second configuration, a distance between the supply and take-up is increased. The first, collapsed configuration may be useful for packaging or shipping the ribbon supply cartridge whereby the collapsed configuration reduces the size of the packaging or shipping box containing the ribbon supply cartridge. When the ribbon supply cartridge is to be used, the user can manually adjust the ribbon supply cartridge to the open configuration and then install the ribbon supply cartridge in the card personalization machine.

15 Claims, 11 Drawing Sheets

(58) Field of Classification Search
USPC ..... 347/214
See application file for complete search history.

(56) References Cited

U.S. PATENT DOCUMENTS

| | | | | |
|---|---|---|---|---|
| 6,522,349 | B1 * | 2/2003 | Lee | B41J 15/044 347/214 |
| 6,726,144 | B2 | 4/2004 | Squires | |
| 6,963,351 | B2 | 11/2005 | Squires et al. | |
| 6,997,629 | B2 | 2/2006 | Bungert et al. | |
| 2008/0219739 | A1 * | 9/2008 | Hoffman | B41J 17/42 400/207 |
| 2012/0226907 | A1 | 9/2012 | Hohberger et al. | |
| 2017/0066269 | A1 * | 3/2017 | Ehara | B41J 17/32 |

* cited by examiner

COLLAPSIBLE RIBBON SUPPLY CARTRIDGE

FIELD

This technical disclosure relates to ribbon supplies that can be used in a number of applications, including card personalization machines such as desktop card personalization machines and central issuance machines.

BACKGROUND

The use of ribbon supplies in card personalization machines is well known. The ribbon supplies typically include a supply roll that supplies unused ribbon and a take-up roll upon which used ribbon material is wound during use of the ribbon supply. In some instances, the ribbon supply may be mounted on a cartridge that is installed into the card personalization machine. Replacement of the ribbon supply of a card personalization machine may be performed by personnel for whom maintenance of the card personalization machine, including ribbon supply replacement, is only an incidental portion of their job, such as a security guard or a desk clerk, and not by personnel who have special training in such equipment. Therefore, the replacement of the ribbon supply should be made to be relatively intuitive and straightforward.

SUMMARY

A ribbon supply cartridge for use in a card personalization machine is described. The ribbon supply cartridge is manually adjustable by a user before installation into the card personalization machine from a first, collapsed (or pre-use) configuration to a second, extended or open (or use) configuration. When the ribbon supply cartridge is adjusted from the first configuration to the second configuration, a distance between the supply and take-up is increased. The first, collapsed configuration may be useful for packaging or shipping the ribbon supply cartridge whereby the collapsed configuration reduces the size of the packaging or shipping box containing the ribbon supply cartridge. When the ribbon supply cartridge is to be used, the user can manually adjust the ribbon supply cartridge to the open configuration and then install the ribbon supply cartridge in the card personalization machine.

In some embodiments, the ribbon supply cartridge can be shipped with a ribbon supply and a ribbon take-up pre-installed on the ribbon supply cartridge. The ribbon supply can include unused ribbon material wound thereon. A leading end of the ribbon material can either be pre-attached to the take-up or the user can attach the leading end to the take-up prior to use. When the ribbon supply cartridge is adjusted from the first configuration to the second configuration, a distance between a rotation axis of the supply and a rotation axis of the take-up is increased. In other embodiments, the ribbon supply cartridge can come without a ribbon supply and a ribbon take-up pre-installed, and the user must install the ribbon supply and the ribbon take-up either prior to adjusting the ribbon supply cartridge from the first configuration to the second configuration, or after adjusting the ribbon supply cartridge from the first configuration to the second configuration.

In some embodiments, the ribbon supply cartridge can simply be discarded once the ribbon material is used up, whereby the ribbon supply cartridge can be considered disposable. Alternatively, in some embodiments, the ribbon supply cartridge may be re-usable with the old supply and take-up cores being removed from the ribbon supply cartridge and new supply and take-up cores being mounted on the ribbon supply cartridge.

In some embodiments, once the ribbon supply cartridge is manually adjusted to the second, extended configuration, the ribbon supply cartridge may optionally be manually adjusted back to the first, collapsed configuration.

In one embodiment, a ribbon supply cartridge can include a support frame, a ribbon supply rotatably mounted on the support frame for rotation about a first rotation axis, where the ribbon supply includes a supply of unused ribbon material, and a ribbon take-up rotatably mounted on the support frame for rotation about a second rotation axis. In addition, a distance between the first rotation axis and the second rotation axis is changeable.

In another embodiment, a ribbon supply cartridge can include a support frame that includes a ribbon supply mounting location at which a ribbon supply can be rotatably mounted for rotation about a first rotation axis, and a ribbon take-up mounting location at which a ribbon take-up can be rotatably mounted for rotation about a second rotation axis. The support frame is configured to permit alteration of a distance between the ribbon supply mounting location and the ribbon take-up mounting location.

In another embodiment, a method of installing a ribbon supply cartridge into a plastic card printer can include manually actuating the ribbon supply cartridge from a collapsed configuration to an extended configuration, where the ribbon supply cartridge has a support frame, a ribbon supply that includes a supply of ribbon material is rotatably mounted on the support frame for rotation about a first rotation axis, and a ribbon take-up that is attached to a leading end of the ribbon material is rotatably mounted on the support frame for rotation about a second rotation axis. There is a first distance between the first rotation axis and the second rotation axis at the collapsed configuration, and there is a second distance between the first rotation axis and the second rotation axis at the extended configuration, and the first distance is less than the second distance. In addition, with the ribbon supply cartridge in the extended configuration, the method includes manually installing the ribbon supply cartridge in the plastic card printer.

DRAWINGS

DETAILED DESCRIPTION

Figure 1:
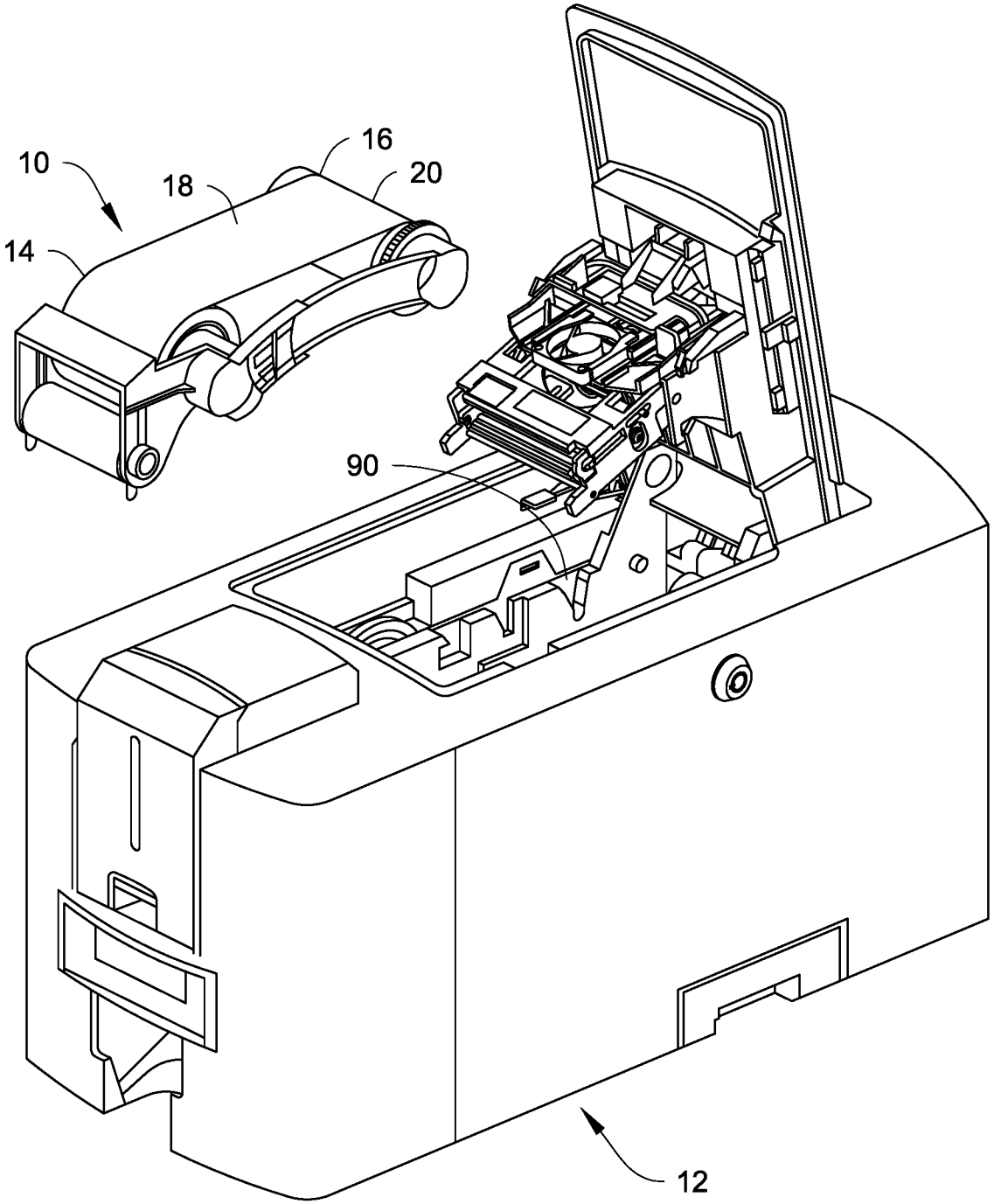
FIG. 1 illustrates the ribbon supply cartridge described herein in the second, extended configuration prior to installation in a card personalization machine.

With reference to FIG. 1, a ribbon supply cartridge 10 for use in a card personalization machine 12 is illustrated. The ribbon supply cartridge 10 is designed so that it can be manually adjustable or actuatable by a user before installation into the card personalization machine 12 from a first, collapsed (or pre-use) configuration (seen in FIGS. 2 and 3) to a second, extended or open (or use) configuration (seen in FIGS. 1, 4 and 5). In the first, collapsed configuration, the overall size of the ribbon supply cartridge is reduced compared to its size when in the second, extended configuration. Reducing the size of the ribbon supply cartridge 10 can be useful for reducing the size of the packaging or shipping box containing the ribbon supply cartridge during shipment as well as reducing storage space requirements prior to use. In the example illustrated in FIG. 1, the card personalization machine 12 is configured as a desktop plastic card printer that performs at least a printing operation on plastic cards input into the machine 12. However, the ribbon supply cartridge 10 can be used in other types and configurations of card personalization machines.

When the ribbon supply cartridge 10 is to be used, the user can manually adjust or actuate the ribbon supply cartridge 10 to the open configuration and then install the ribbon supply cartridge 10 into the card personalization machine 12 for use. As described in more detail below, the cartridge 10 defines a ribbon supply mounting location at which a ribbon supply 14 can be rotatably mounted for rotation about a first rotation axis, and a ribbon take-up mounting location at which a ribbon take-up 16 can be rotatably mounted for rotation about a second rotation axis spaced from the first rotation axis. When the ribbon supply cartridge 10 is in the first, collapsed configuration, there is a first distance between the ribbon supply mounting location and the ribbon take-up mounting location. However, when the cartridge 10 is actuated to the second configuration, there is a second distance between the ribbon supply mounting location and the ribbon take-up mounting location, where the second distance is larger than the first distance. Therefore, the cartridge 10 can be described as permitting alteration of the distance between the ribbon supply mounting location and the ribbon take-up mounting location.

FIG. 1 illustrates the ribbon supply 14 and the ribbon take-up 16 rotatably mounted on the ribbon supply cartridge 10. The ribbon supply 14 includes unused ribbon material 18 wound thereon that is suitable for use in the card personalization machine 12, and a leading end 20 of the ribbon material 18 is attached to the ribbon take-up 16. During use of the ribbon material 18, the ribbon take-up 16 is rotated to wind the used ribbon material 18 onto the ribbon take-up 16, while the ribbon supply 14 is rotated to feed new ribbon material 18 for use. The ribbon supply cartridge 10 can be shipped with the ribbon supply 14 and the ribbon take-up 16 pre-installed on the ribbon supply cartridge 10, with the leading end 20 either pre-attached to the take-up 16 or the user can attach the leading end 20 to the take-up 16 prior to use. In other embodiments, the ribbon supply cartridge 10 can come without the ribbon supply 14 and the ribbon take-up 16 pre-installed, and the user must install the ribbon supply 14 and the ribbon take-up 16 onto the ribbon supply cartridge 10 either prior to adjusting the ribbon supply cartridge 10 from the first configuration to the second configuration, or after adjusting the ribbon supply cartridge 10 from the first configuration to the second configuration.

The ribbon material 18 can be any ribbon material used in a card personalization machine. Examples of ribbon materials include, but are not limited to, print ribbon, a ribbon containing one or more laminates, a ribbon containing a topcoat material, a retransfer ribbon, a cleaning ribbon, an indent ribbon, or a topping foil.

Referring to FIGS. 1-5, the cartridge 10 includes a support frame 30 having a supply end 32 and a take-up end 34. The frame 30 has a main section 36 at the supply end 32 and an arm 38 that extends from the main section 36 to the take-up end 34. The supply end 32 defines the ribbon supply mounting location while the take-up end 34 defines the ribbon take-up mounting location. In particular, with reference to FIGS. 3 and 5-7, the supply end 32 includes a supply spindle 40 at the ribbon supply mounting location, and a take-up spindle 42 at the ribbon take-up mounting location. The spindles 40, 42 extend parallel to each other, with the spindle 40 extending from the main section 36 substantially perpendicular to the arm 38 and the spindle 42 extending from the arm 38 substantially perpendicular thereto. In the illustrated example, the spindles 40, 42 are non-rotatably fixed on the support frame 30, i.e. the spindles 40, 42 do not rotate about their longitudinal axis.

The support frame 30 and the spindles 40, 42 can be made from any material(s) that is suitable for use in the card personalization machine 12. Examples of suitable materials include, but are not limited to, plastics such as polystyrene, metals, and non-plastic and non-metallic materials such as cardboard, and combinations thereof.

Figure 2:
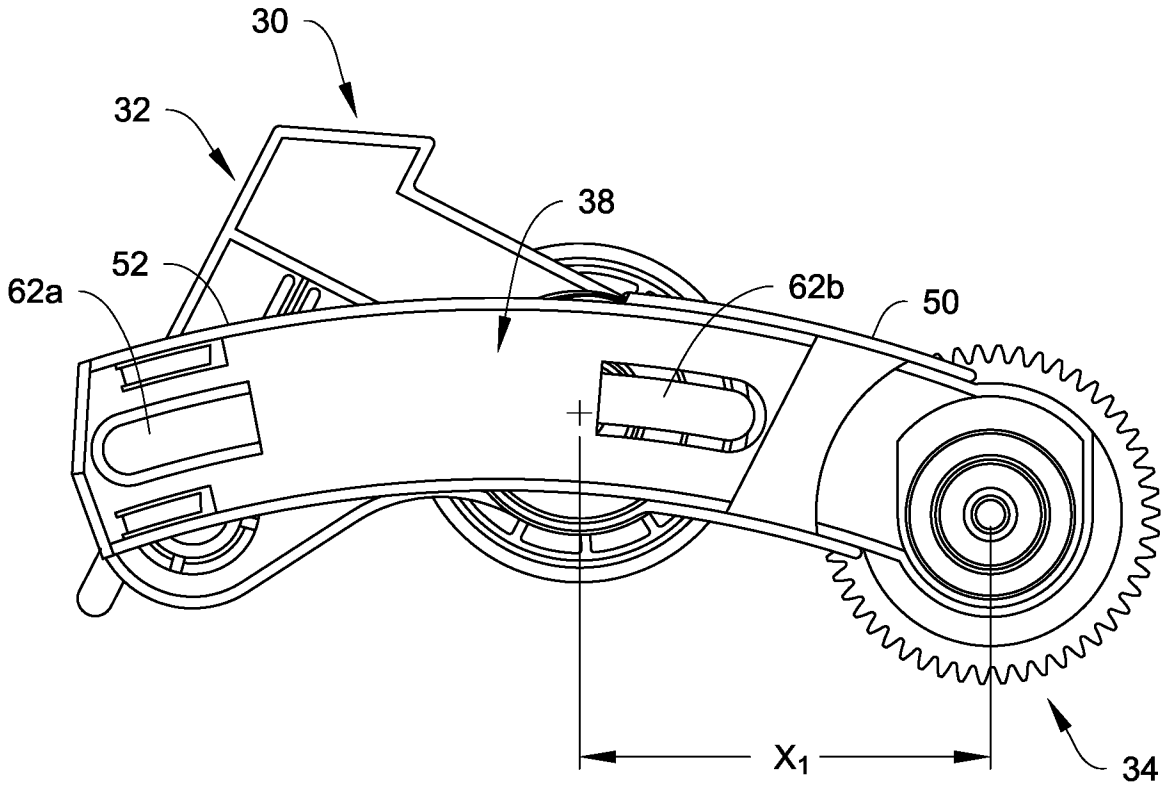
FIG. 2 is a side view of the ribbon supply cartridge described herein in the first, collapsed configuration.
Figure 3:
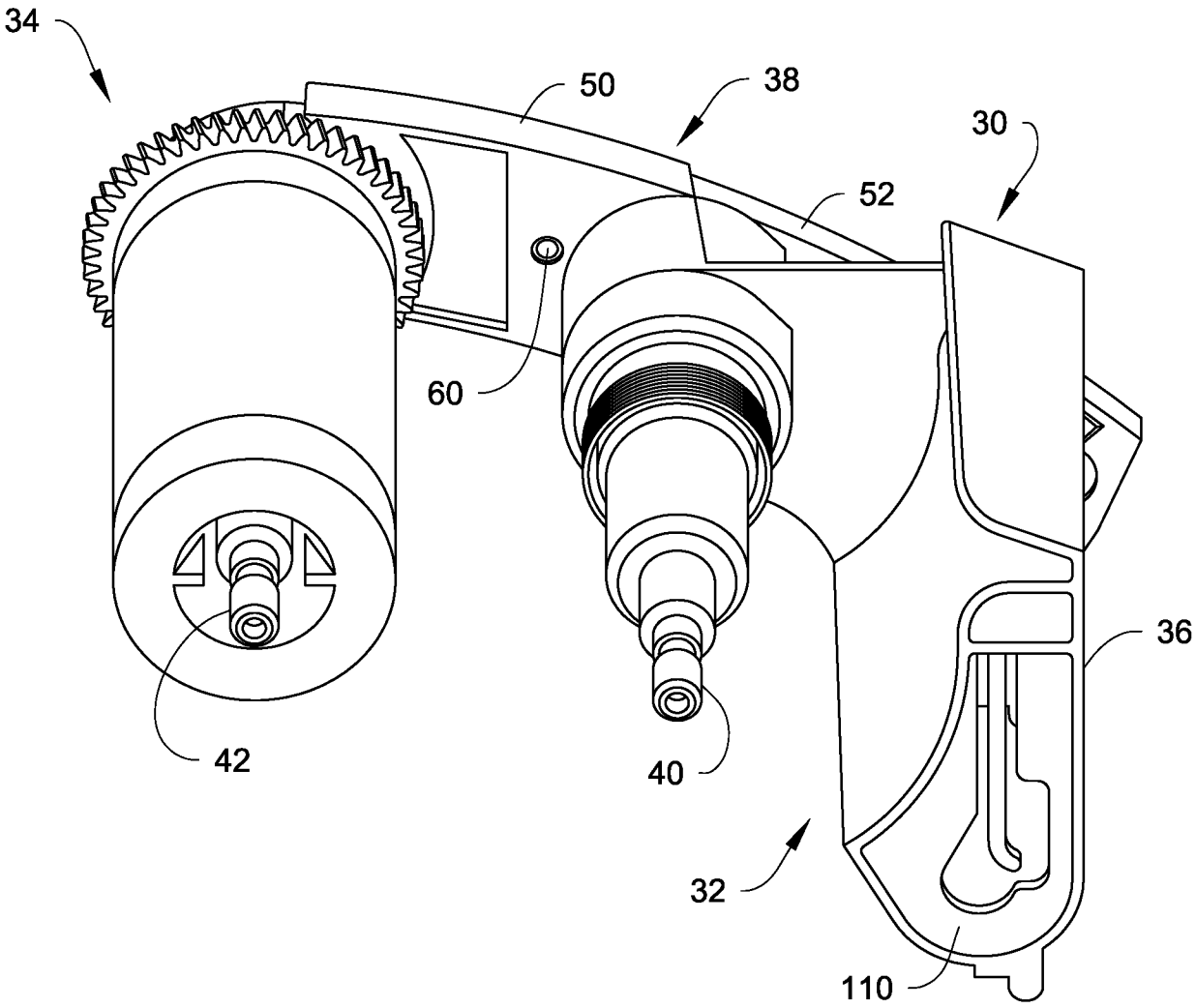
FIG. 3 is a side perspective view of the ribbon supply cartridge described herein in the first, collapsed configuration from the opposite side shown in FIG. 2.
Figure 4:
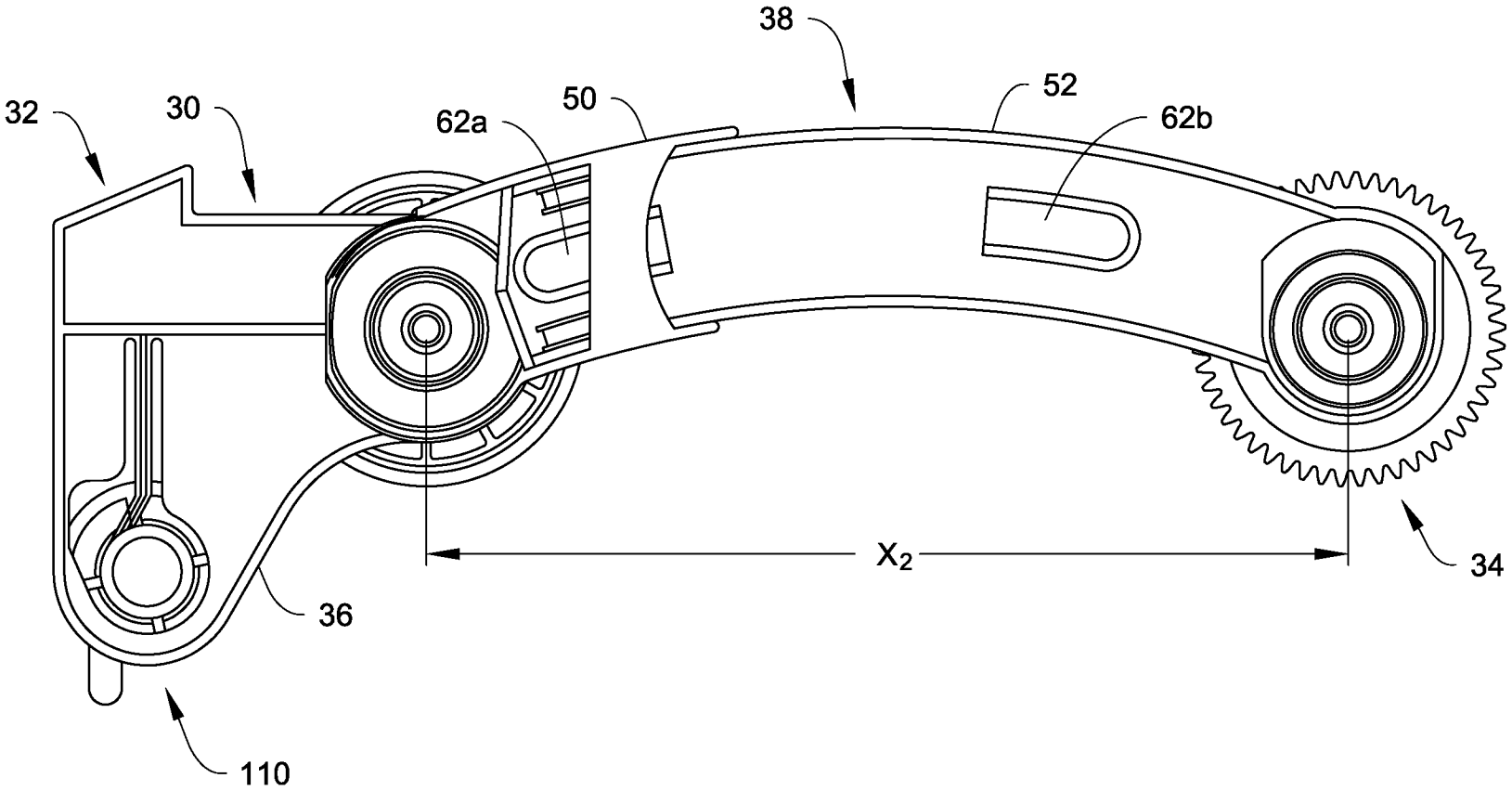
FIG. 4 is a side view of the ribbon supply cartridge described herein in the second, extended configuration.

Referring to FIGS. 1-5, the arm 38 has a first section 50 that extends from the main section 36. The first section 50 is fixed and does not move relative to the main section 36. The arm 38 further includes a second section 52 that is slidable relative to the first section 50 in a telescoping manner from a retracted position shown in FIGS. 2 and 3 to an extended position shown in FIGS. 4 and 5. The take-up spindle 42 is mounted on and fixed to the second section 52 so as to move with the second section 52. Therefore, movement of the second section 52 to the extended position moves the take-up spindle 42 away from the supply spindle 40 and increases the distance between the spindles 40, 42. For example, referring to FIG. 2, there is a first distance $X_1$ between the axes of the spindles 40, 42 when the cartridge 10 at the first configuration. However, as shown in FIG. 4, there is a second distance $X_2$ between the axes of the spindles 40, 42 when the cartridge 10 is at the second configuration, with $X_2$ being greater than $X_1$, due to the extension of the second section 52 which moves the take-up spindle 42 away from the supply spindle 40.

Figure 5:
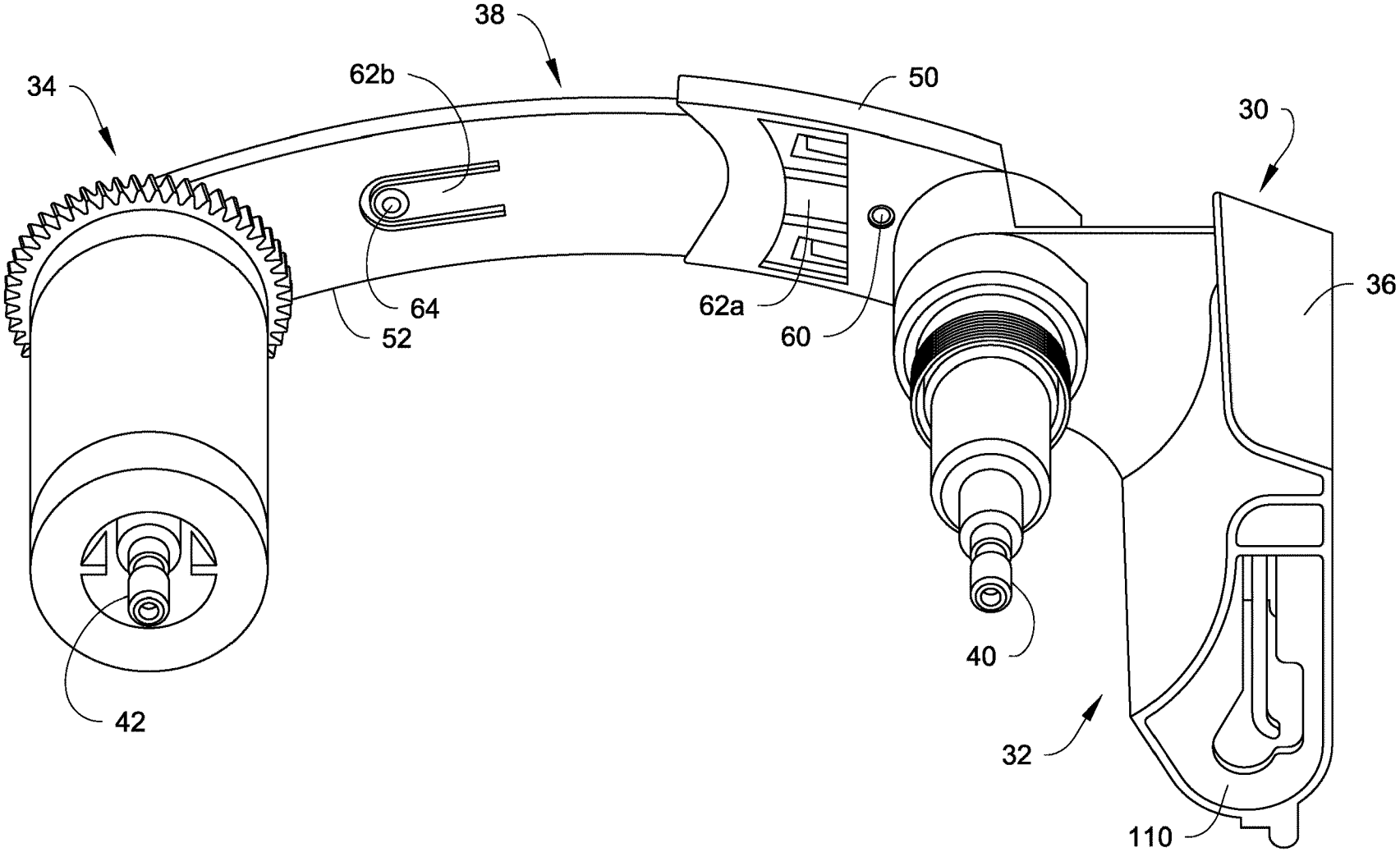
FIG. 5 is a side perspective view of the ribbon supply cartridge described herein in the second, extended configuration from the opposite side shown in FIG. 4.

The cartridge 10 can include a lock that temporarily retains the cartridge at the first, collapsed configuration as well as at the second, extended configuration. The lock can have any configuration that is suitable for temporarily retaining the cartridge at these two configurations. For example, in the illustrated example, the lock is a detent mechanism. In particular, the detent mechanism includes a detent hole 60 formed in the first section 50 as best seen in FIGS. 3 and 5. The detent mechanism also includes a pair of detent arms

62*a*, 62*b* formed on the second section 52 at spaced locations from one another as seen in FIGS. 2, 4 and 5. Each detent arm 62*a*, 62*b* is a tab formed by a cut-out in the material of the second section 52 with one end of the tab integrally formed with (or otherwise attached or fixed to) the second section 52. The end of each tab opposite the end integrally formed with the second section includes a protuberance or projection 64 that is sized and configured to fit within the detent hole 60.

As shown in FIGS. 2 and 3, in the first, collapsed configuration, the protuberance 64 of the detent arm 62*b* fits within the detent hole 60 thereby preventing movement of the second section 52 relative to the first section 50 and thereby retaining the cartridge 10 at the first, collapsed configuration. The retaining force of the protuberance 64 within the detent hole 60 can be designed to be manually overcome by a user applying sufficient force to slide the second section 52 relative to the first section 50. Alternatively, the retaining force of the protuberance 64 within the detent hole 60 can be large enough to require the user to insert a pin or other narrow object through the reverse side of the detent hole 60 shown in FIG. 3 to unseat the protuberance 64 from the detent hole 60 before the second section 52 can slide relative to the first section 50. However the retaining force is overcome, once overcome the cartridge 10 can be expanded to the second, extended configuration by sliding the second section 52 relative to the first section 50 to the position shown in FIGS. 4 and 5. At the second, extended configuration, the protuberance 64 of the detent arm 62*a* fits within the detent hole 60 thereby preventing movement of the second section 52 relative to the first section 50 and thereby retaining the cartridge 10 at the second, expanded configuration.

Figure 6:
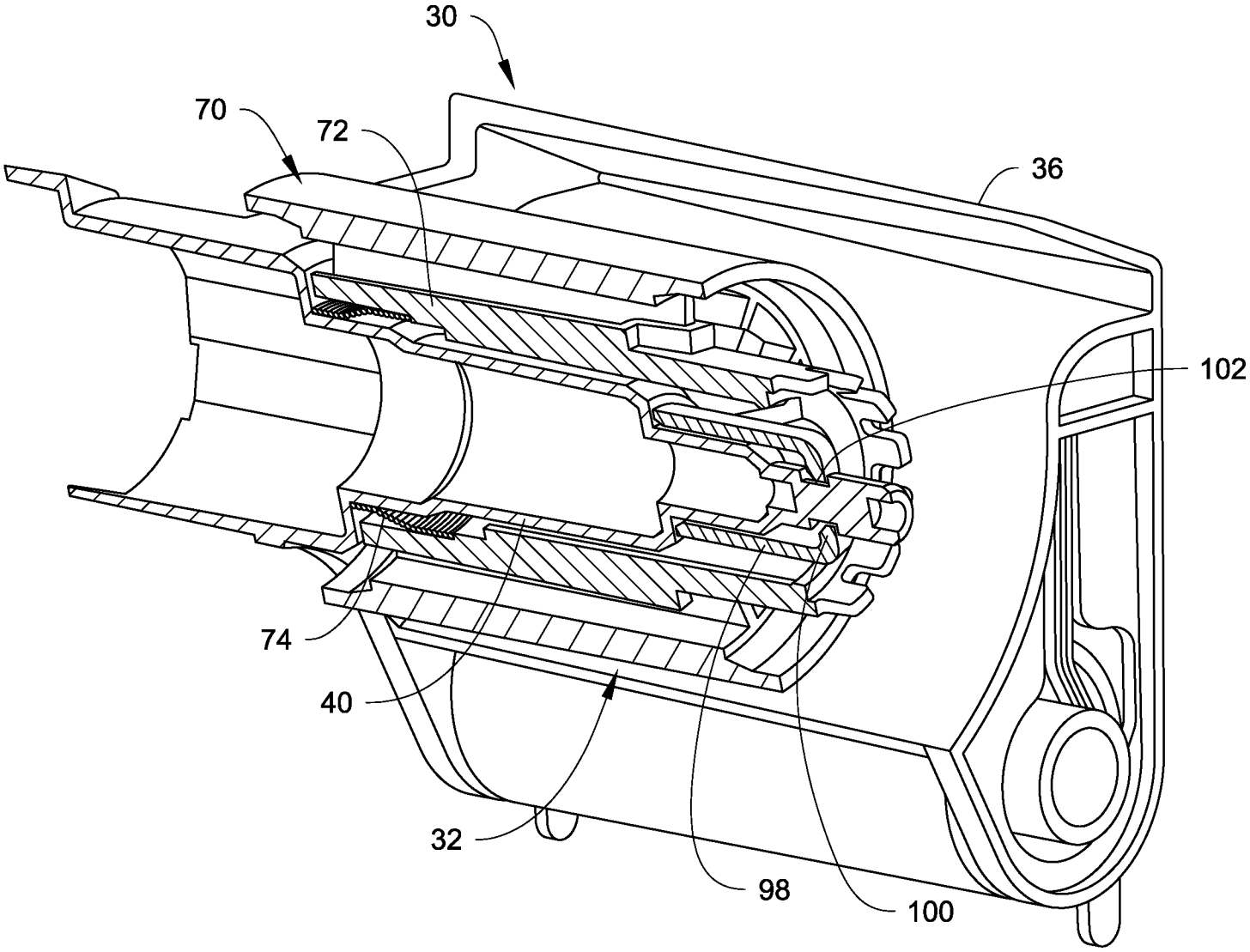
FIG. 6 is a cross-sectional perspective view of the supply side of the ribbon supply cartridge with a ribbon supply mounted at a ribbon supply mounting location on the ribbon supply cartridge.

Referring to FIG. 6, the supply end 32 can include a supply core 70 and a supply core retainer 72. The supply core retainer 72 snap fit connects onto the supply spindle 40 and acts as an adaptor to allow the supply core 70 to mount to the supply end 32. The supply core retainer 72 is rotatable relative to the spindle 40, with a clutch spring 74 between the supply core retainer 72 and the spindle 40 providing a back tension force resisting the rotation of the retainer 72. The supply core 70 is mounted on the retainer 72 and forms the core around which the unused ribbon material 18 is initially wound. The core 70 and the retainer 72 are fixed to one another to prevent relative rotation therebetween and so that the core 70 and the retainer 72 rotate together about the spindle 40 when feeding new ribbon to be used. The supply core 70 can have a construction similar or identical to the cores described in U.S. Pat. Nos. 6,726,144 and 6,997,629, the entire contents of which are incorporated herein by reference. In some embodiments, the core 70 can be removable from the retainer 72 by the user to allow replacement of the ribbon supply. In other embodiments, the retainer 72 is not necessary and is not used, in which case the spindle 40 and/or the core 70 are designed to allow the core 70 to mount directly to the spindle 40 without the retainer 72, in which case the core 70 would be rotatable relative to the spindle 40 and the clutch spring 74 would be between the spindle 40 and the core 70.

The supply core retainer 72 can be connected to and rotatably disposed on the supply spindle 40 in any suitable manner. For example, as illustrated in FIG. 6, the interior of the supply core retainer 72 can include a stabilizer 98 that guides the retainer 72 (and the core 70) over the end of the spindle 40 and stabilizes the end of the retainer 72 relative to the spindle 40, and a snap connector mechanism 100 that snap-fit connects within a circumferential channel 102 formed in the spindle 40. In one embodiment, the connection between retainer 72 and the spindle 40 can be designed to make removal of the retainer 72 (together with the supply core 70) from the spindle 40 difficult, or even impossible without a suitable tool, for the end user to prevent the end user from removing the supply from the cartridge 10.

Figure 7:
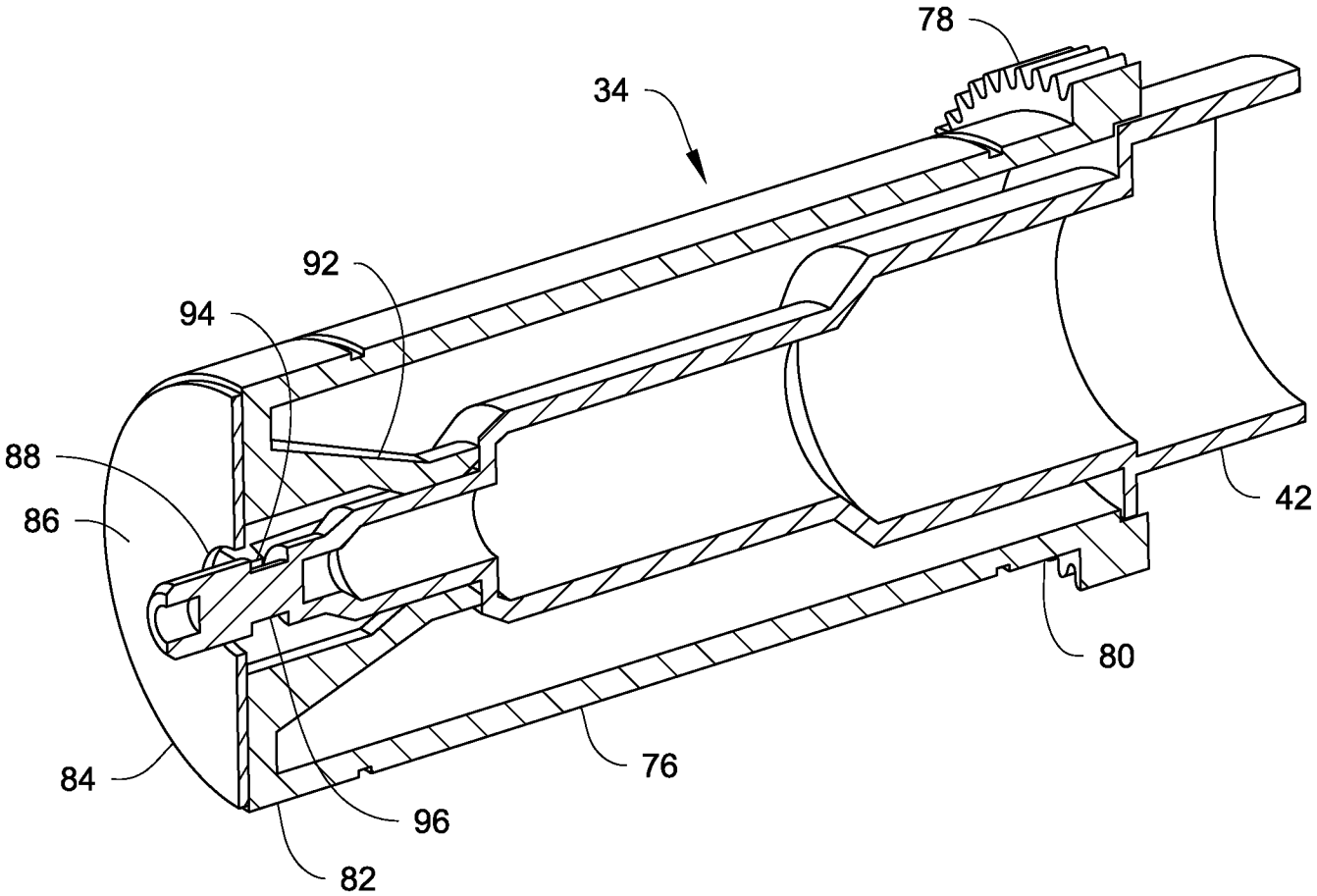
FIG. 7 is a cross-sectional perspective view of the take-up side of the ribbon supply cartridge with a ribbon take-up mounted at a ribbon take-up mounting location on the ribbon supply cartridge.

Referring to FIG. 7, the take-up end 34 can include a take-up core 76 connected to and rotatably disposed on the take-up spindle 42. The take-up core 76 forms a core on which the used ribbon material 18 is wound. In the illustrated example, a drive gear 78 is disposed at a first or proximal end 80 of the core 76. In operation, the drive gear 78 is engaged by a drive gear (not shown) of a drive train (not shown) connected to a drive motor (not shown) for rotating the take-up core 76 as the ribbon material 18 is used to wind the used ribbon material 18 onto the core 76 and to feed new ribbon material 18 from the supply core 70. In the illustrated example, the drive gear 78 is illustrated as being integrally formed with the take-up core 76 to form an integral, unitary, one-piece construction with the core 76. In other embodiments, the drive gear 78 need not be integrally formed with the core 76 but can be initially separate from the core 76 but later suitably attached to the core 76 in a manner suitable to transfer rotational drive force from the drive gear 78 to the core 76.

With continued reference to FIG. 7, a second or distal end 82 of the core 76 forms a surface that is suitable for allowing mounting of a radio frequency identification (RFID) tag 84. In this example, the RFID tag 84 is ring-shaped or donut-shaped with a substantially flat body 86 and a central opening 88 to allow a distal end of the take-up spindle 42 to pass therethrough. The mounting of ring-shaped RFID tags on ribbon take-up cores is known from U.S. Pat. Nos. 6,963,351 and 6,997,629, the entire contents of which are incorporated herein by reference. Referring to FIG. 1, the RFID tag 84 can be read by a suitable reader 90 located in the card personalization machine 12.

Referring back to FIG. 7, the take-up core 76 can be connected to and rotatably disposed on the take-up spindle 42 in any suitable manner. For example, as illustrated, the interior of the core 76 can include a stabilizer 92 that guides the core 76 over the end of the spindle 42 and stabilizes the end 82 of the core 76 relative to the spindle 42, and a snap connector mechanism 94 that snap-fit connects within a circumferential channel 96 formed in the spindle 42.

FIGS. 2-5 further illustrate that the main section 36 of the frame 30 can optionally be configured to include a mounting section 110 to allow mounting of an adhesive cleaning sleeve 112 (FIGS. 8 and 9) to the cartridge 10. In operation of the machine 12, the cleaning sleeve 112 is engaged with one or more cleaning rollers that clean the surface(s) of the card to be printed on prior to printing, whereby the cleaning roller(s) cleans the card surface(s) and the cleaning sleeve 112 removes contaminants from the cleaning roller(s). The sleeve 112 includes an adhesive thereon, and prior to use the sleeve 112 is covered by a removable covering or tape 114 that protects the sleeve 112 prior to use. The removable covering or tape needs to be removed from the sleeve 112 in order for the sleeve 112 to function correctly.

Figure 8:
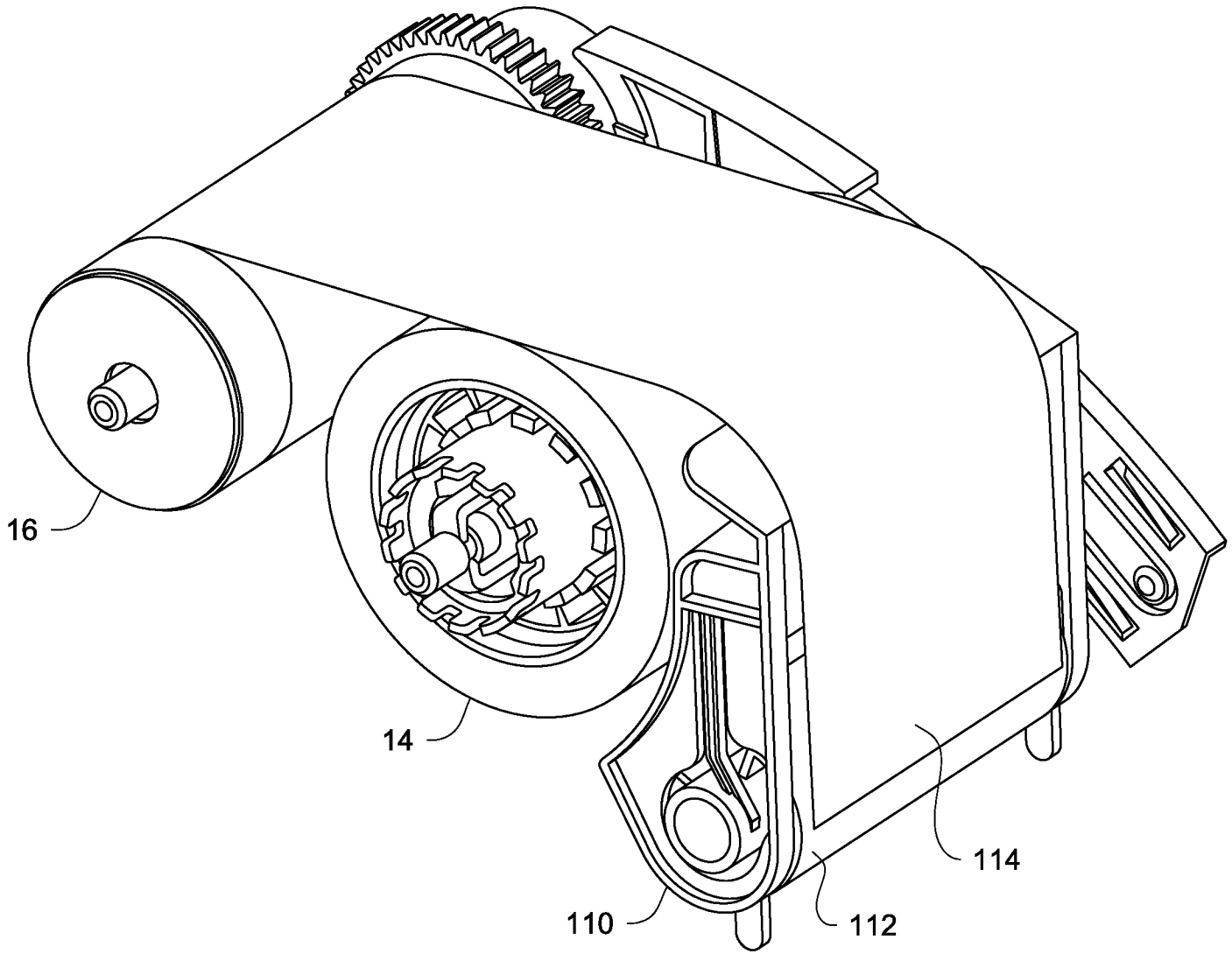
FIG. 8 illustrates an embodiment of the ribbon supply cartridge in the collapsed configuration with a cleaning ribbon.
Figure 9:
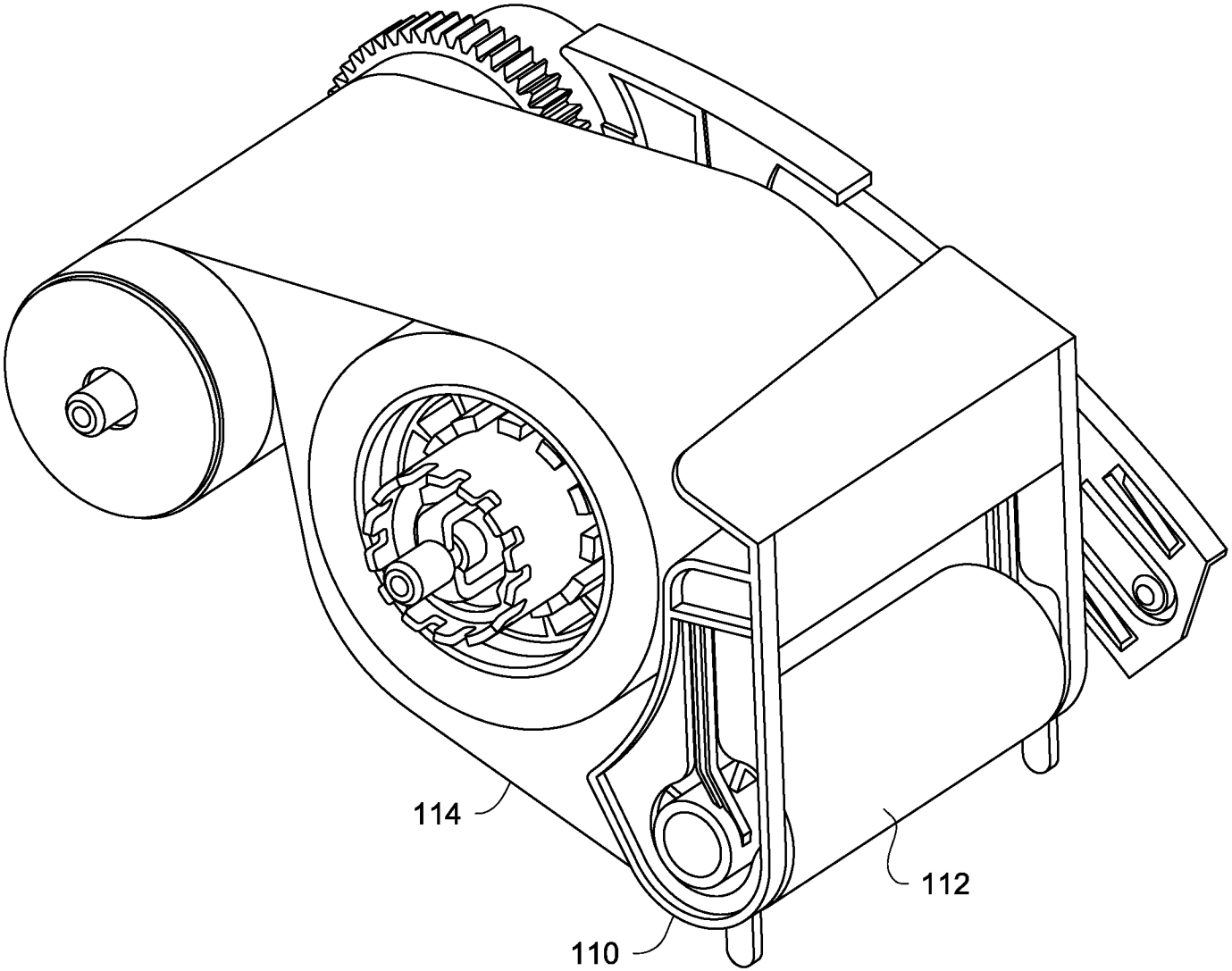
FIG. 9 illustrates another embodiment of the ribbon supply cartridge in the collapsed configuration with a cleaning ribbon.

FIGS. 8 and 9 illustrate two different embodiments that demonstrate how the removable covering 114 can be automatically removed from the sleeve 112 when the cartridge 10 is expanded from the first, collapsed (or pre-use) configuration to the second, extended or open (or use) configuration. In FIG. 8, the removable covering 114 (or a leader portion that extends from the removable covering 114) extends over the ribbon supply 14 with the end of the covering 114 connected to the ribbon take-up 16. When the cartridge 10 is expanded or opened from the collapsed configuration shown in FIG. 8, the covering 114 is unwrapped from the sleeve 112, thereby exposing the adhesive sleeve 112, and ultimately the covering 114 is wound onto the take-up 16 along with the used ribbon material 18. In FIG. 9, the covering 114 (or a leader portion that extends from the removable covering 114) extends under the ribbon supply 14 with the end of the covering 114 connected to the ribbon take-up 16. When the cartridge 10 is expanded or opened from the collapsed configuration shown in FIG. 9, the covering 114 is unwrapped from the sleeve 112, thereby exposing the adhesive sleeve 112, and ultimately the covering 114 is wound onto the take-up 16 along with the used ribbon material 18.

Figure 10:
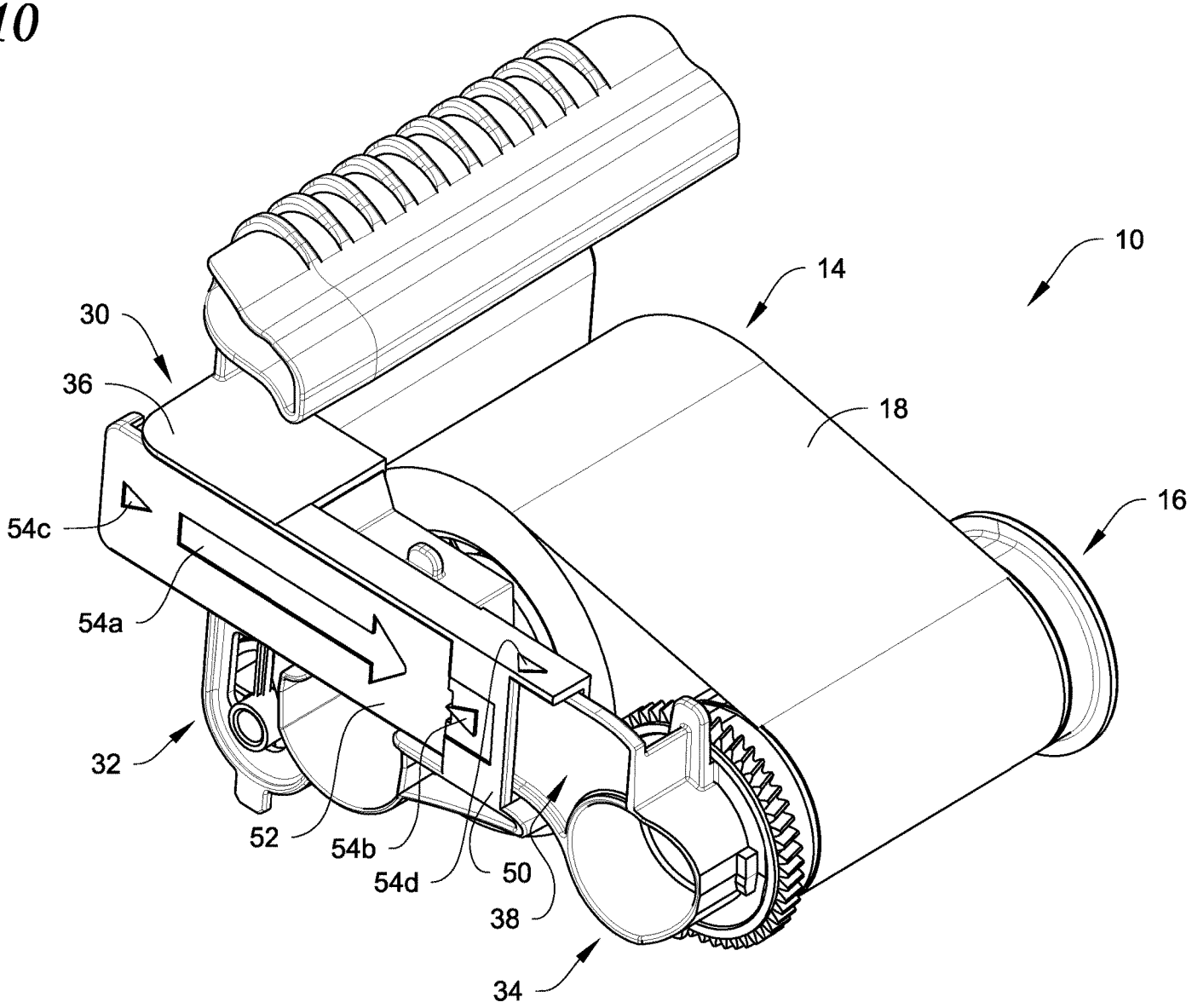
FIG. 10 illustrates another embodiment of a ribbon supply cartridge in the collapsed configuration.
Figure 11:
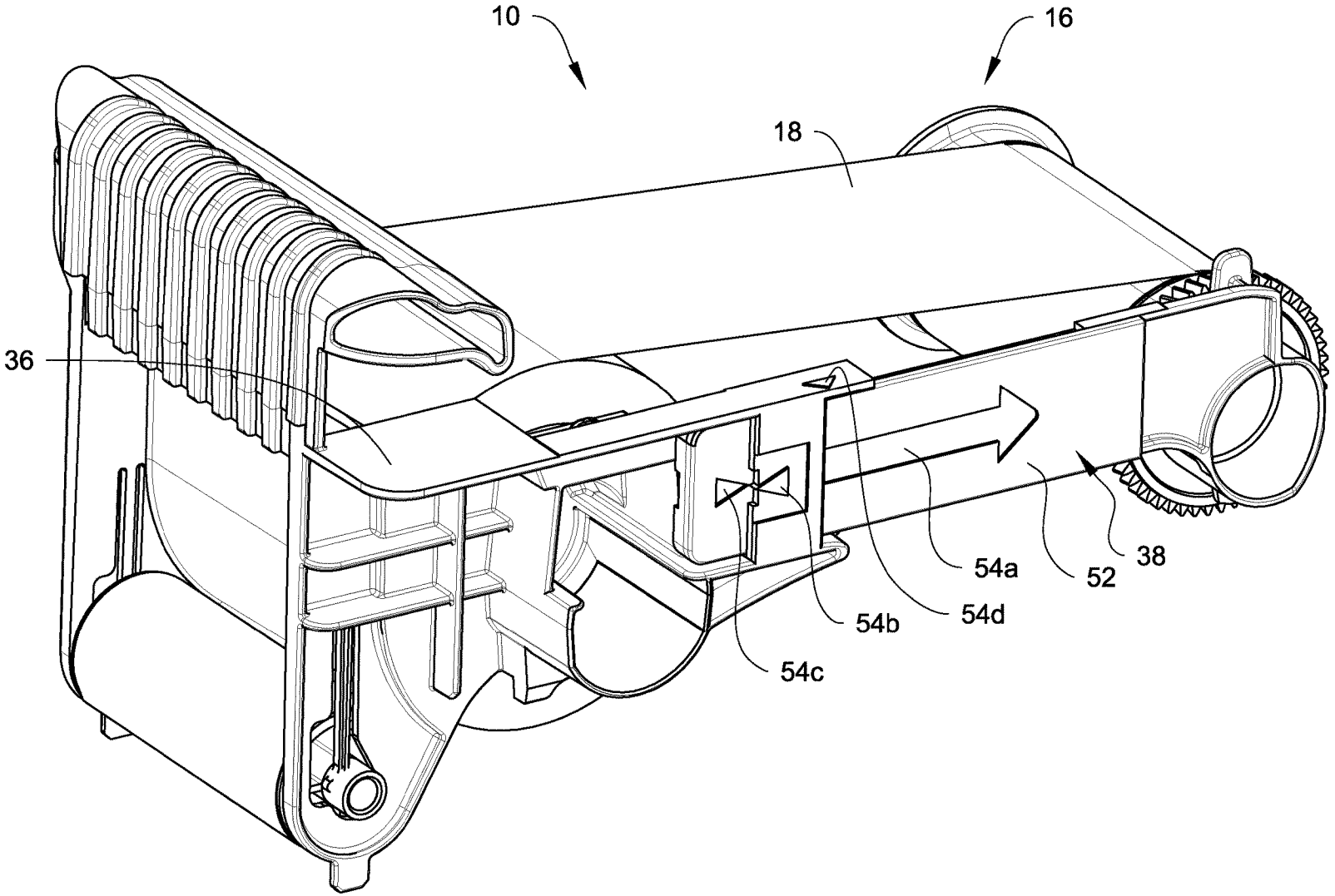
FIG. 11 illustrates the embodiment of FIG. 10 in the second, extended configuration.

FIGS. 10-11 illustrate another embodiment of the ribbon supply cartridge 10. The cartridge 10 in FIGS. 10-11 is similar in construction and operation to the cartridge 10 in FIGS. 1-9, and like elements are referenced using the same reference numbers.

In FIGS. 10-11, the cartridge 10 includes the support frame 30 having the supply end 32 and the take-up end 34. The frame 30 has the main section 36 at the supply end 32 and the arm 38 that extends from the main section 36 to the take-up end 34. The supply end 32 defines the ribbon supply mounting location while the take-up end 34 defines the ribbon take-up mounting location. The supply end 32 includes the supply spindle at the ribbon supply mounting location, and the take-up spindle at the ribbon take-up mounting location. The supply and take-up spindles extend parallel to each other, with the supply spindle extending from the main section 36 substantially perpendicular to the arm 38 and the take-up spindle extending from the arm 38 substantially perpendicular thereto.

In the embodiment in FIGS. 10-11, the arm 38 has the first section 50 that extends from the main section 36, where the first section 50 is fixed and does not move relative to the main section 36. The arm 38 further includes the second section 52 that is slidable relative to the first section 50 in a telescoping manner from a retracted position shown in FIG. 10 to an extended position shown in FIG. 11. The take-up spindle is mounted on and fixed to the second section 52 so as to move with the second section 52. Therefore, movement of the second section 52 to the extended position moves the take-up spindle away from the supply spindle and increases the distance between the supply and take-up spindles.

In the embodiment in FIGS. 10-11, the arm 38 is substantially straight or linear instead of being curved as in the embodiment in FIGS. 1-9. In addition, the cartridge 10 can include indicia to aid the user in expanding and installing the cartridge 10. For example, the second section 52 can be provided with an arrow 54*a* that indicates the correct opening or expansion direction of the cartridge 10. In addition, the first section 50 can be provided with an arrow 54*b*, while the second section 52 can also be provided with an arrow 54*c*. As depicted in FIG. 11, when the tips of the two arrows 54*b*, 54*c* align with each other, that is an indication that the cartridge 10 is fully expanded and ready to be installed. In addition, the first section 50 can be provided with another arrow 54*d* that indicates the direction the cartridge 10 should face when being installed in the card personalization machine.

The cartridge 10 in FIGS. 10-11 can also include a lock that temporarily retains the cartridge at the second, extended configuration. The lock can have any configuration that is suitable for temporarily retaining the cartridge at these two configurations. For example, the lock can be a detent mechanism (not visible) that includes a detent recess (not visible) formed in the backside (i.e. non-visible side in FIGS. 10-11) of the second section 52 of the arm 58 generally directly opposite the arrow 54*c* which receives a detent protuberance (not visible) formed on the first section 50 of the arm 38 when the cartridge is extended to retain the cartridge at the extended configuration. Optionally, a lock, such as a detent mechanism, can also be provided to temporarily retain the cartridge 10 at the first, collapsed position.

The cartridge 10 in FIGS. 10-11 is otherwise similar to the cartridge in FIGS. 1-9 and functions similarly, including the take-up core having the integral drive gear, RFID tag, supply core, and supply core retainer.

The ribbon supply cartridge described herein can be configured for use in a card personalization machine, such as a desktop card personalization machine or a central issuance machine. One example of a card personalization machine is a plastic card printer that can be configured as a desktop plastic card printer or configured as a plastic card printing mechanism or module used in a central issuance card personalization system. A card personalization machine is configured to personalize or otherwise process plastic cards including, but not limited to, credit cards, debit cards, identification cards, driver's licenses, gift cards, and other plastic cards.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A ribbon supply cartridge, comprising:

a support frame;

a ribbon supply rotatably mounted on the support frame for rotation about a first rotation axis, the ribbon supply includes a supply of unused ribbon material;

a ribbon take-up rotatably mounted on the support frame for rotation about a second rotation axis;

wherein a distance between the first rotation axis and the second rotation axis is changeable;

wherein the support frame is adjustable from a first, collapsed configuration with a first distance between the first rotation axis and the second rotation axis, to a second, extended configuration with a second distance between the first rotation axis and the second rotation axis; and the first distance is less than the second distance;

a lock on the ribbon supply cartridge that is configured to retain the support frame at the first, collapsed configuration; or a lock on the ribbon supply cartridge that is configured to retain the support frame at the second, extended configuration.

2. The ribbon supply cartridge of claim 1, wherein the unused ribbon material includes a leading end that is attached to the ribbon take-up.

3. The ribbon supply cartridge of claim 1, wherein the unused ribbon material comprises a print ribbon, a ribbon containing one or more laminates, a ribbon containing a topcoat material, a retransfer ribbon, a cleaning ribbon, an indent ribbon, or a topping foil.

4. The ribbon supply cartridge of claim 1, wherein the ribbon supply cartridge is configured for use in a card personalization machine.

5. The ribbon supply cartridge of claim 1, wherein the ribbon supply cartridge is configured for use in a plastic card printer.

6. A ribbon supply cartridge, comprising:

a support frame;

a ribbon supply rotatably mounted on the support frame for rotation about a first rotation axis, the ribbon supply includes a supply of unused ribbon material;

a ribbon take-up rotatably mounted on the support frame for rotation about a second rotation axis;

wherein a distance between the first rotation axis and the second rotation axis is changeable;

wherein the support frame is adjustable from a first, collapsed configuration with a first distance between the first rotation axis and the second rotation axis, to a second, extended configuration with a second distance between the first rotation axis and the second rotation axis; and the first distance is less than the second distance;

the ribbon supply comprises a supply core containing the unused ribbon material wound thereon;

the ribbon take-up comprises a take-up core attached to an end of the unused ribbon material; and the take-up core comprises a drive gear integrally formed therewith adjacent a first end of the take-up core, and a radio frequency identification tag is mounted on the take-up core adjacent to a second end thereof.

7. A ribbon supply cartridge, comprising:

a support frame that includes a ribbon supply mounting location at which a ribbon supply can be rotatably mounted for rotation about a first rotation axis, and a ribbon take-up mounting location at which a ribbon take-up can be rotatably mounted for rotation about a second rotation axis;

wherein the support frame is configured to permit alteration of a distance between the ribbon supply mounting location and the ribbon take-up mounting location;

wherein the support frame is adjustable from a first, collapsed configuration with a first distance between the ribbon supply mounting location and the ribbon take-up mounting location, to a second, extended configuration with a second distance between the ribbon supply mounting location and the ribbon take-up mounting location; and the first distance is less than the second distance; and a lock on the ribbon supply cartridge that is configured to retain the support frame at the first, collapsed configuration; or a lock on the ribbon supply cartridge that is configured to retain the support frame at the second, extended configuration.

8. The ribbon supply cartridge of claim 7, wherein the ribbon supply cartridge is configured for use in a card personalization machine.

9. The ribbon supply cartridge of claim 7, wherein the ribbon supply cartridge is configured for use in a plastic card printer.

10. A ribbon supply cartridge, comprising:

a support frame that includes a ribbon supply mounting location at which a ribbon supply can be rotatably mounted for rotation about a first rotation axis, and a ribbon take-up mounting location at which a ribbon take-up can be rotatably mounted for rotation about a second rotation axis;

wherein the support frame is configured to permit alteration of a distance between the ribbon supply mounting location and the ribbon take-up mounting location;

wherein the support frame is adjustable from a first, collapsed configuration with a first distance between the ribbon supply mounting location and the ribbon take-up mounting location, to a second, extended configuration with a second distance between the ribbon supply mounting location and the ribbon take-up mounting location; and the first distance is less than the second distance;

a supply spindle at the ribbon supply mounting location, and a supply core containing ribbon material wound thereon is mounted on the supply spindle;

a take-up spindle at the ribbon take-up mounting location, and a take-up core is mounted on the take-up spindle, and an end of the ribbon material is attached to the take-up core; and the take-up core comprises a drive gear integrally formed therewith adjacent a first end of the take-up core, and a radio frequency identification tag is mounted on the take-up core adjacent to a second end thereof.

11. The ribbon supply cartridge of claim 10, wherein the ribbon material wound on the supply core comprises a print ribbon, a ribbon containing one or more laminates, a ribbon containing a topcoat material, a retransfer ribbon, a cleaning ribbon, an indent ribbon, or a topping foil.

12. A method of installing a ribbon supply cartridge into a plastic card printer, comprising:

manually actuating the ribbon supply cartridge from a collapsed configuration to an extended configuration and locking the ribbon supply cartridge at the extended configuration; the ribbon supply cartridge having a support frame, a ribbon supply that includes a supply of ribbon material is rotatably mounted on the support frame for rotation about a first rotation axis, and a ribbon take-up that is attached to a leading end of the ribbon material is rotatably mounted on the support frame for rotation about a second rotation axis; where there is a first distance between the first rotation axis and the second rotation axis at the collapsed configuration, and there is a second distance between the first rotation axis and the second rotation axis at the extended configuration, and the first distance is less than the second distance;

with the ribbon supply cartridge in the extended configuration, manually installing the ribbon supply cartridge in the plastic card printer.

13. The method of claim 12, wherein the ribbon material comprises a print ribbon, a ribbon containing one or more laminates, a ribbon containing a topcoat material, a retransfer ribbon, a cleaning ribbon, an indent ribbon, or a topping foil.

14. A ribbon supply cartridge, comprising:

a support frame;

a ribbon supply rotatably mounted on the support frame for rotation about a first rotation axis, the ribbon supply includes a supply of unused ribbon material;

a ribbon take-up rotatably mounted on the support frame for rotation about a second rotation axis;

wherein a distance between the first rotation axis and the second rotation axis is changeable;

wherein the support frame is adjustable from a first, collapsed configuration with a first distance between the first rotation axis and the second rotation axis, to a second, extended configuration with a second distance between the first rotation axis and the second rotation axis; and the first distance is less than the second distance; and a lock on the ribbon supply cartridge that is configured to retain the support frame at the first, collapsed configuration; and a lock on the ribbon supply cartridge that is configured to retain the support frame at the second, extended configuration.

15. A ribbon supply cartridge, comprising:

a support frame that includes a ribbon supply mounting location at which a ribbon supply can be rotatably mounted for rotation about a first rotation axis, and a ribbon take-up mounting location at which a ribbon take-up can be rotatably mounted for rotation about a second rotation axis;

wherein the support frame is configured to permit alteration of a distance between the ribbon supply mounting location and the ribbon take-up mounting location;

wherein the support frame is adjustable from a first, collapsed configuration with a first distance between the ribbon supply mounting location and the ribbon take-up mounting location, to a second, extended configuration with a second distance between the ribbon supply mounting location and the ribbon take-up mounting location; and the first distance is less than the second distance; and a lock on the ribbon supply cartridge that is configured to retain the support frame at the first, collapsed configuration; and a lock on the ribbon supply cartridge that is configured to retain the support frame at the second, extended configuration.

* * * * *